US005695249A

United States Patent [19]

Lotfi

[11] Patent Number: 5,695,249

[45] Date of Patent: Dec. 9, 1997

[54] HEIGHT ADJUSTMENT MECHANISM FOR CHAIR COMPONENTS

[76] Inventor: Mehdian Lotfi, 8201 Lankershim Blvd., North Hollywood, Calif. 91605

[21] Appl. No.: 668,723

[22] Filed: Jun. 24, 1996

[51] Int. Cl.[6] ..... A47C 7/46

[52] U.S. Cl. ..... 297/353

[58] Field of Search ..... 297/353, 411.36

[56] References Cited

U.S. PATENT DOCUMENTS

| | | | |
|---|---|---|---|
| 3,854,772 | 12/1974 | Abrahamson et al. | 297/353 |
| 4,451,084 | 5/1984 | Seeley | 297/353 |
| 4,639,039 | 1/1987 | Donovan | 297/353 |
| 4,749,230 | 6/1988 | Tornero | 297/353 |
| 5,324,096 | 6/1994 | Schultz | 297/411.36 |
| 5,382,079 | 1/1995 | Wilson et al. | 297/411.36 |

FOREIGN PATENT DOCUMENTS

| | | | |
|---|---|---|---|
| 4230230 | 3/1994 | Germany | 297/411.36 |

*Primary Examiner*—Peter R. Brown

[57] ABSTRACT

An improved height adjustment mechanism for vertically positioning and releasably locking one chair component relative to another chair component. The mechanism generally used for vertically adjusting position of chair backrest and armrests. The improved height adjustment mechanism comprises a J-bar and a slidably interlocking channel component having a slot with multiple vertical lock notches. A latch bar is pivotally mounted on the J-bar having a latch tip which releasably engages lock notches on the channel component.

5 Claims, 3 Drawing Sheets

HEIGHT ADJUSTMENT MECHANISM FOR CHAIR COMPONENTS

BACKGROUND OF THE INVENTION

The present invention relates generally to mechanisms which enable components of a chair to be adjustably vertically positioned relative to another chair component. More particularly, it relates to chair backrest and armrest height adjustment mechanism which allows raising and lowering of the chair component to multiple releasably locking vertical positions.

Many types of backrest height adjustment mechanisms have been presented in the prior arts. The most basic form includes a cam rotatably mounted in a bracket. The cam along with a cylindrical rod having a handle provide cam action when the rod is rotated. A modified version of this cam mechanism was presented in U.S. Pat. No. 5,382,077. U.S. Pat. No. 5,405,189 also presented another form of this type of mechanism. The primary disadvantage of this type of mechanism is that it requires that the user manipulate either a hand wheel, a button or a lever to vertically adjust the height of the component relative to the seat. Generally, the mechanisms have many parts and require extensive assembly. This factor makes this type of mechanism uneconomical and undesirable.

Another type of backrest height adjustment mechanism includes a slot having a plurality of notches. A spring guided mechanism having a latch pin releasably engages the notches at the desired height. The releasing of the engagement of the notches is achieved by either a handle or by other mechanisms. U.S. Pat. No. 4,639,039 discloses one embodiment of this type of mechanism. In this invention, the latch pin engages the notches at each level and at the bottom-most position the spring mechanism is reset and the latch pin is allowed to again engage the top-most position. This mechanism is expensive to manufacture because the number of components and their arrangement. It is also very complex in design and manufacture. Further, the spring loaded latch pin causes a loud noise when reset at the bottom-most position which is undesirable in some work environments.

U.S. Pat. No. 4,749,230 issued to Tornero discloses another invention for chair backrest height adjustment having a slot and plurality of notches as in above. This invention uses a lock pin to engage each notch and has done away with the spring latch pin. Although an improvement over the spring type mechanism, this invention also has shortcomings which make the present invention more desirable. The Tornero invention is difficult and time consuming to assemble because of the lock pin position and placement. The whole mechanism must be assembled before the backrest is attached as the lock pin is not easily inserted into the slot assembly. Further, the assembly requires and inset in the backrest of the chair to accommodate the unit and insertion of the J-bar, a feature which is not standard in the industry and not present in most all backrests. This units operation relies on the presumption that the chair is always in a perfectly vertical position. When the chair is tilted to one side even slightly, the lock pin fails to engage the notches causing falling of the unit.

SUMMARY OF THE PRESENT INVENTION

An improved height adjustment mechanism for vertically positioning and releasably locking one chair component relative to another chair component. The improved height adjustment mechanism comprises a J-bar attached to the chair frame. The J-bar is slidably mounted on a guide plate having two tracks for holding the J-bar in position for vertical movement along the guide plate. The guide plate also has a slot with multiple lock notches along one vertical edge. A latch bar is pivotally mounted on the J-bar with a pivot screw near one end of the latch. The pivot screw is specially designed such that the thread does not extend to the head of the screw. This partial thread arrangement allows for free rotational movement of the latch bar about the pivot screw when the screw is tightened on the J-bar. The latch bar has a latch tip which releasably engages lock notches on the channel component. The slot of the channel component also has a release cam at its lowest end after the lowermost notch and is releasably engageable with the lower portion of the latch bar. Lifting of the chair component relative to the chair frame beyond the maximum height position provided for by the lowermost lock notch causes the latch bar to pivot from the latched position and unlock remaining in a standby position. While in the standby position, the chair component may be lowered to its minimum height position. As the chair component is lowered to the minimum height position, the latch bar slidably engages an engaging cam surface along the slot leading to the uppermost lock notch. Sliding along the this inclined surface moves the latch bar into a latched position with the uppermost lock notch causing the latch tip to engage the lock notch. Thereafter, Lifting of the chair component with respect to the chair frame causes the latch pin to engage other lock notch positions between the uppermost and the lowermost lock notch. The lifting of the chair component causes the latch tip to slidably move along an upper lock notch into a lower lock notch, thereafter engaging the lower lock notch. The process is repeated once the lock tip of the latch bar reaches the lowermost lock notch.

The height adjustment mechanism of the present invention has various advantages over the prior art. Aside from the self locking mechanism feature which requires no external levers or handles, this invention has numerous other features. The most notable advantage of the present invention is the ease and cost effectiveness of manufacture. The present invention does not require an additional plastic slide to be fixed to the J-bar. It uses the J-bar as the slide plate for its operations eliminating one manufactured piece, thereby making the unit more economic. The weakest points of every height adjustment mechanism are the points where the units come in contact with other chair components. Since the J-bar is slidably integrated within the guide plate, the whole unit is stronger and can withstand a far greater amount of back pull.

Another feature of this improved mechanism is that the latch bar is pivotally attached to the J-Bar with one pivot screw. With this arrangement, only one hole is needed in a standard J-bar for the attachment of the height adjustment mechanism. Further, the pivot screw is inserted from the back of the J-bar which is easily accessible. This greatly reduces the cost of manufacture since the assembly process is very simple and expedient. Yet another advantage is that this mechanism does not require an indentation in the back of the chair component, but is merely affixed to the chair component. Because of its simple and compact design, this mechanism could be used for chair armrests as well as backrests.

The mechanism used in latching a height position by the present invention is also advantageous over the prior art. This mechanism is highly reliable and does not experience misses in latching. This reliability is due to the design and shape of the latch bar which utilizes the gravitational pull to lock each position.

DRAWINGS

DESCRIPTION OF THE PREFERRED EMBODIMENT

Figure 2:
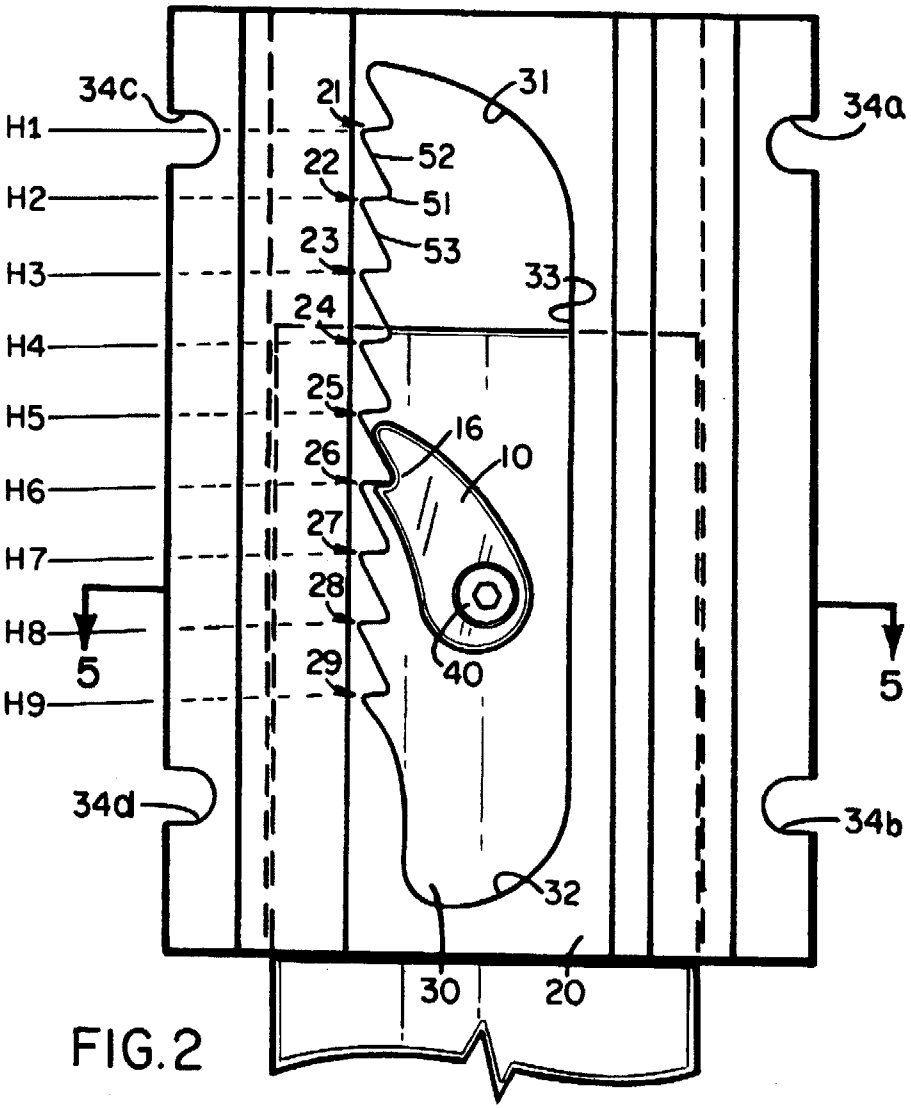
FIG. 2 is a two dimensional frontal plan view of the mechanism of FIG. 1.
Figure 1:
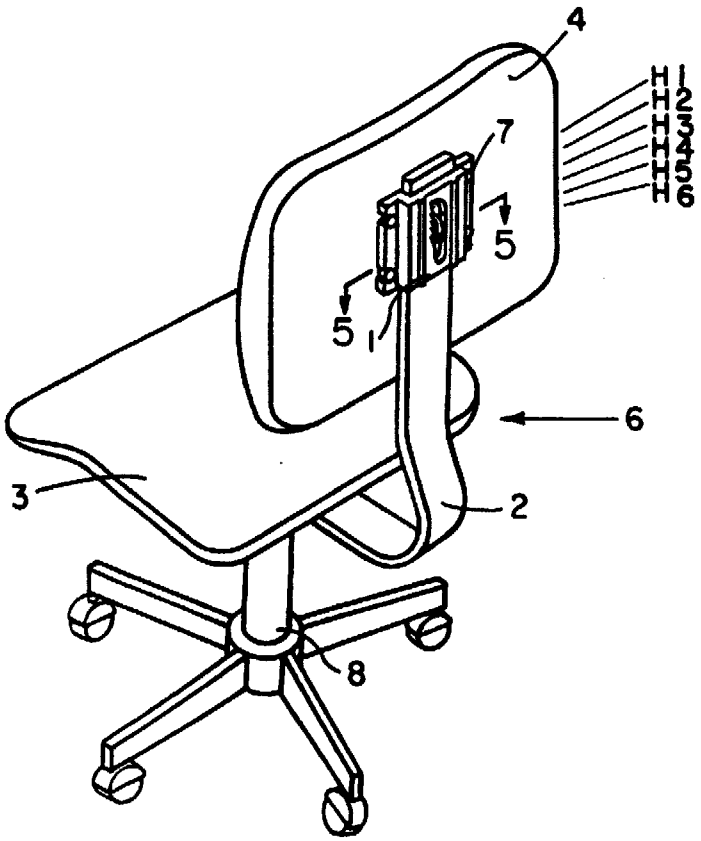
FIG. 1 is a rear view of a chair with the improved height adjustment mechanism in accordance with the present invention.
Figure 6:
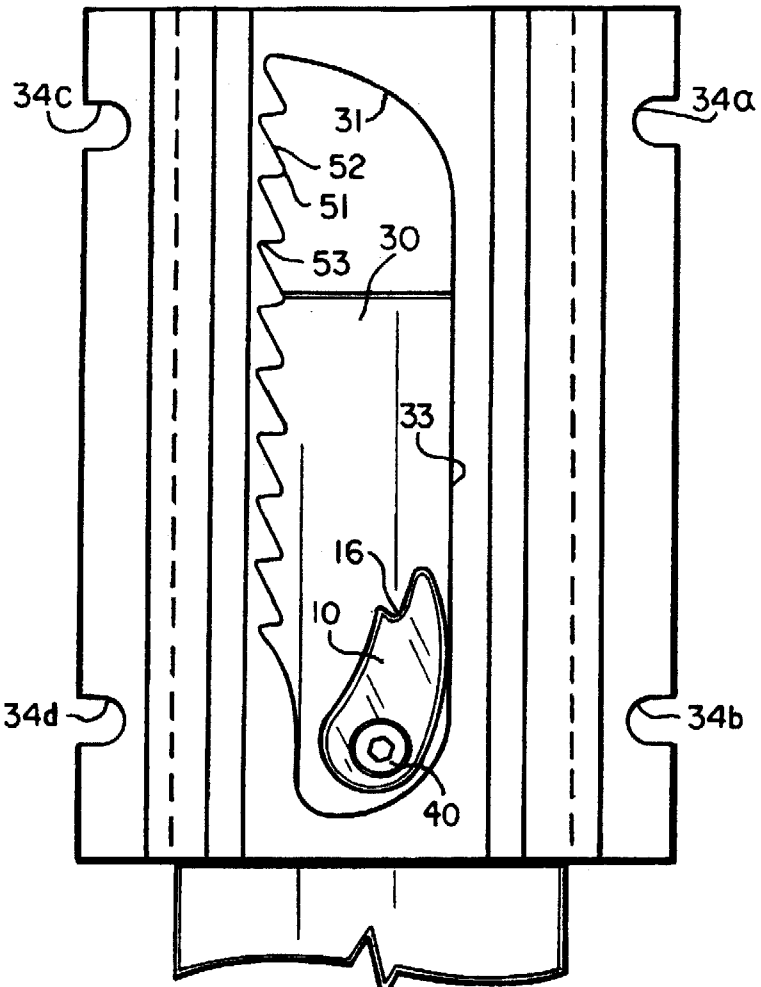
FIG. 6 is a dimensional frontal plan view of the mechanism of FIGS. 1 & 2 showing latch bar in a release position.
Figure 4:
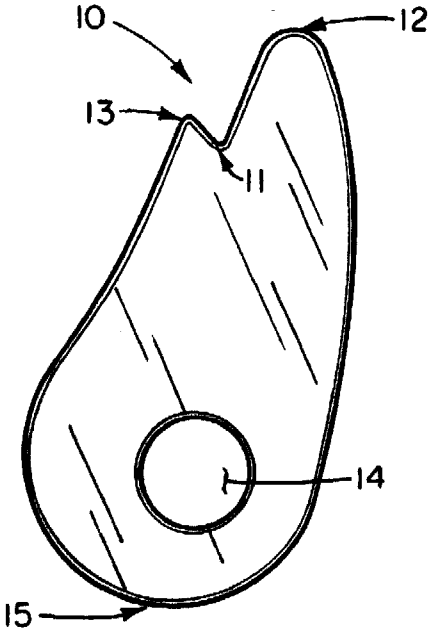
FIG. 4 is a dimensional plan view of the latch bar shown in FIG. 2.
Figure 3:
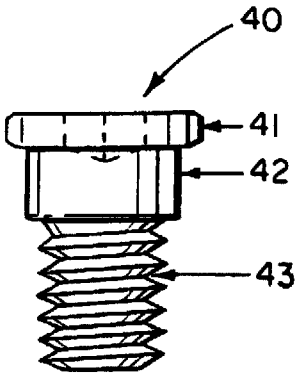
FIG. 3 is a three dimensional view of the pivot screw shown in FIG. 2.
Figure 5:
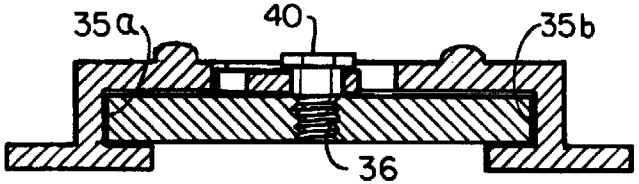
FIG. 5 is a two dimensional cross-sectional view of mechanism shown in FIGS. 1 & 2 taken in line 5—5.

Referring to FIG. 1, the chair height adjustment mechanism which is the object of this invention (hereinafter mechanism) 1 is attached to chair 6. Chair 6 comprises of seat 3 attached to chair frame 8, J-bar 2 rigidly attached at one end to chair frame 8 and extending therefrom to mechanism 1 and backrest 4 rigidly attached to mechanism 1. The mechanism 1 allows for manual adjustment of the height of the backrest 4 relative to the chair frame 8 by releasably latching among a plurality of positions H1, H2, H3, H4, H5, and H6. The mechanism 1 is preferably covered by a plastic or fabric compartment (not shown) which covers the inner workings of the mechanism 1.

In FIGS. 1, 2, 2*a*, 5, 6 and 7, mechanism 1 is shown comprising a guide plate 20 rigidly secured to a backrest 4 with bolts (not shown) secured through notches 34*a*, 34*b*, 34*c*, and 34*d*. The J-bar 2 is slidably received by tracks 35*a* and 35*b* of the guide plate 20 such that the J-bar 2 vertically slides along the tracks 35*a* and 35*b*. The guide plate 20 has a slot 30 comprising a plurality of lock notches 21 through 29, a release cam 32, a flat portion 33, and an engaging cam 31. Each of the plurality of lock notches 21 through 29 has a convex tongue 51 and two concave seats 52 and 53. A latch bar 10 is pivotally mounted on J-bar 2 with pivot screw 40 such that it is inside slot 30. The latch bar 10 has a latch tip 16 comprising a concave mouth 11 and two convex lips 12 and 13 for latching convex tongue 51 and concave seats 52 and 53 of plurality of lock notches 21 through 29, respectively. The latch bar 10 has a non-threaded hole 14, smaller is diameter than screw head 41, for receiving non-threaded neck 42 of pivot screw 40 such that latch bar 10 pivotally rotates about pivot screw 10. The J-bar 2 has a threaded hole 36 for receiving the threaded body 43 of pivot screw 40. Manually raising backrest 4 causes guide plate 20 to move vertically up with respect to J-bar 2 and latch bar 10. This movement causes latch tip 16 of the latch bar 10 to disengage one of plurality of lock notches 21 through 29 and engage a lower of the plurality of lock notches 21 through 29, thereby engaging a higher adjustable backrest lock position. Raising backrest 4 beyond highest lock position H9 causes release end 15 of latch bar 10 to releasably engage release cam 32 extending from the lowest lock notch 29. The engagement of release end 15 and release cam 32 pivots latch bar 10 clockwise about pivot screw 40 into a standby position. While in the standby position, backrest 4 is lowered to its lowest position H1 with respect to J-bar 2. Latch bar 10 comes in contact with engaging cam 31 as backrest 4 is lowered to its lowest position. This contact pivots latch bar 10 counterclockwise from its standby position to latching of lock notch 21. The cycle is thereafter repeated as backrest 4 is raised and latch tip 16 releases lock notch 21 and engages lock notch 22, vertically moving backrest 4 to a higher H2 height level.

Figure 7:
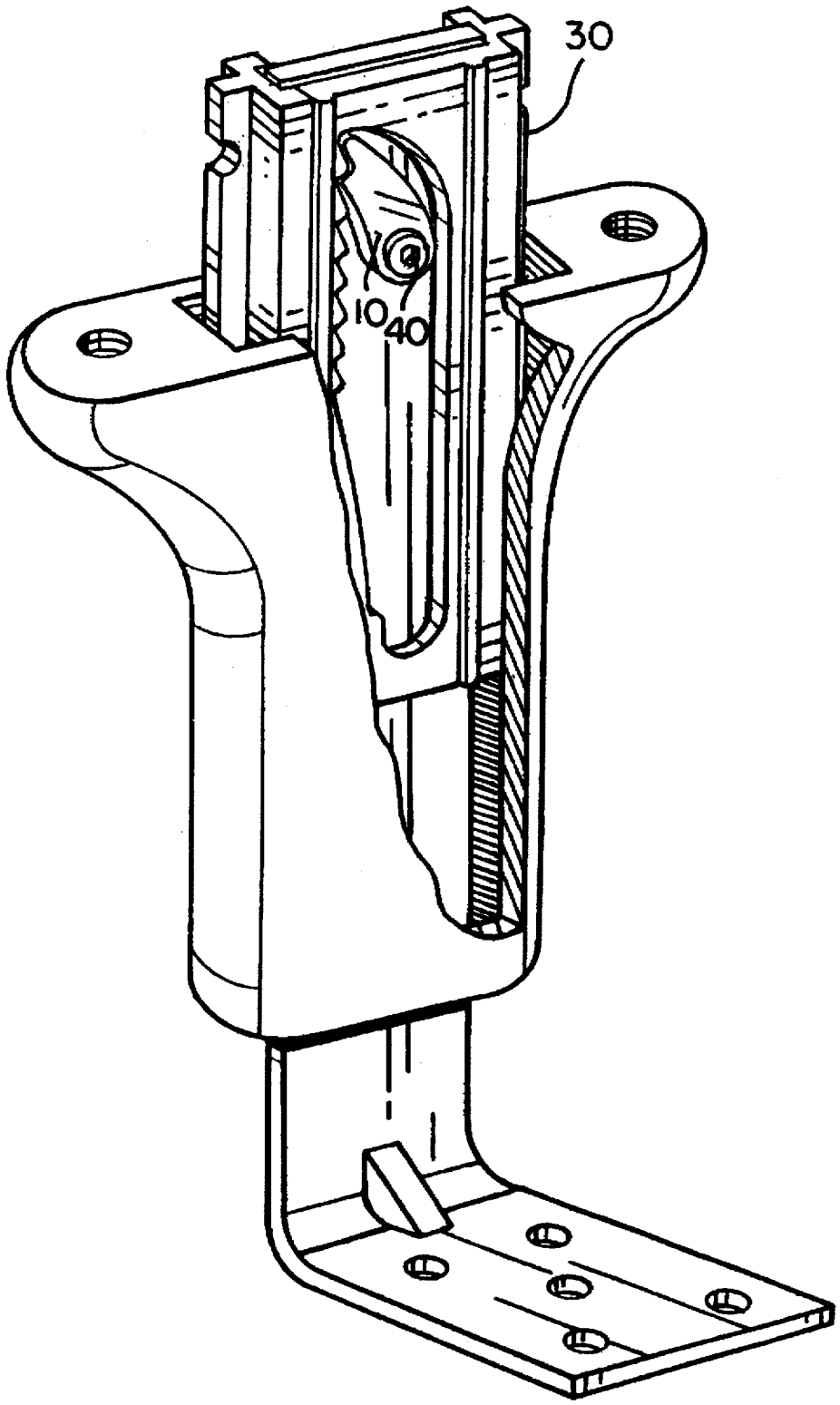
FIG. 7 is a three dimensional view of mechanism of FIG. 2 as used in an armrest.

Although the drawings and the description above refers to nine height level H1 through H9, the invention may have more or less height adjustment levels as needed. The invention as described is used for a chair backrest, but may be used in an armrest or with other chair components for height adjustment, as shown in FIG. 7.

I claim:

1. A chair height adjustment mechanism for releasably adjusting height of one chair component in any plurality of positions relative to another chair component and relative to a chair frame comprising:

a. a J-bar which is rigidly secured to a said chair frame;

b. a guide plate is rigidly secured to said one chair component having at least two tracks for slidably receiving said J-bar for sliding movement between two extreme positions;

c. latching means for releasably latching said guide plate to said J-bar comprising:

i. a latch bar pivotally mounted on the J-bar having;

ii. a latch tip at one end of said latch bar;

iii. a release end at other end of said latch bar;

iv. a pivot screw for pivotally mounting said latch bar on said J-bar;

v. a slot in said guide plate;

vi. a plurality of lock notches on one side of said slot for releasably receiving said latch tip having a highest lock notch at one end of said plurality of lock notches and a lowest lock notch on another end of said plurality of lock notches;

d. a release cam on said slot extending from said lowest lock notch for releasably receiving said release end of said latch bar and pivoting said latch bar about said pivot screw to a standby position away from said lowest lock notch;

e. an engaging cam on said slot extending from said highest lock notch for slidably receiving and pivoting said latch bar about said pivot screw from said standby position to latch highest lock notch.

2. A chair height adjustment mechanism according to claim 1 wherein said pivot screw comprises of a screw head, a non-threaded neck having a greater length than thickness of said latch bar and a threaded body extending from said non-threaded neck.

3. A chair height adjustment mechanism according to claim 1 wherein said J-bar contains a threaded hole for receiving said pivot screw.

4. A chair height adjustment mechanism according to claim 1 wherein said latch bar has a non-threaded hole for receiving said pivot screw.

5. A chair height adjustment mechanism according to claim 1 wherein said J-bar is mounted perpendicular to said chair frame.

* * * * *